US005929725A

United States Patent [19]

Toda et al.

[11] Patent Number: 5,929,725

[45] Date of Patent: Jul. 27, 1999

[54] DIELECTRIC FILTER USING THE TEM MODE

[75] Inventors: Jun Toda; Kikuo Tsunoda, both of Ishikawa-ken; Haruo Matsumoto, Kanazawa, all of Japan

[73] Assignee: Murata Manufacturing Co., Ltd., Japan

[21] Appl. No.: 08/780,320

[22] Filed: Jan. 8, 1997

[30] Foreign Application Priority Data

Jan. 8, 1996 [JP] Japan ..... 8-000895
Dec. 5, 1996 [JP] Japan ..... 8-325445

[51] Int. Cl.[6] ..... H01P 1/202; H01P 1/205

[52] U.S. Cl. ..... 333/202; 333/206

[58] Field of Search ..... 333/202, 203, 333/204, 206

[56] References Cited

U.S. PATENT DOCUMENTS

| | | | |
|---|---|---|---|
| 4,151,494 | 4/1979 | Nishikawa et al. | 333/204 |
| 4,386,328 | 5/1983 | Masuda et al. | 333/202 |
| 4,559,508 | 12/1985 | Nishikawa et al. | 333/202 |
| 5,311,159 | 5/1994 | Miura et al. | 333/204 |

FOREIGN PATENT DOCUMENTS

| | | | |
|---|---|---|---|
| 093956 | 11/1983 | European Pat. Off. . | |
| 2341210 | 9/1977 | France . | |
| 6-53705 | 2/1994 | Japan | 333/206 |

*Primary Examiner*—Seungsook Ham
*Attorney, Agent, or Firm*—Ostrolenk, Faber, Gerb & Soffen, LLP

[57] ABSTRACT

A dielectric filter with a shorting conductor for improving a spurious response characteristic in a mode other than a fundamental mode (TEM mode). Two resonator holes having inner conductors formed on their inner surfaces are formed through a dielectric block between a pair of end surfaces. An outer conductor is formed on outer surfaces of the dielectric block. A through hole is formed through a central portion of the dielectric block between two major surfaces of the block, and a shorting conductor is formed on the inner surface of the through hole to be connected to outer conductor portions on the two major surfaces of the dielectric block. The shorting conductor is disposed at a location where the electric field strength of the undesired mode is high.

10 Claims, 5 Drawing Sheets

DIELECTRIC FILTER USING THE TEM MODE

BACKGROUND OF THE INVENTION

1. Field of the Invention

The present invention relates to a dielectric filter using transverse electromagnetic (TEM) mode and constructed by forming a plurality of inner conductors in a dielectric block and by forming an outer conductor on outer surfaces of the dielectric block and, more particularly, to a dielectric filter of this construction having an improved spurious response characteristic.

2. Description of the Related Art

FIG. 8 shows the structure of a conventional dielectric filter using TEM mode. In FIG. 8 and similar illustrations referred to below, a dotted area represents an exposed portion of a dielectric block (non-conductor-formation portion).

In this dielectric filter, as shown in FIG. 8, two resonator holes 2*a* and 2*b* are formed through a dielectric block 1 in the form of a rectangular prism so as to have openings in a pair of opposite end surfaces of the dielectric block 1. An inner conductor 3 which functions as a resonating conductor is formed on the inner cylindrical surface of each of the resonators 2*a* and 2*b*. An outer conductor 4 which functions as a ground conductor is formed generally over all the outer surfaces of the dielectric block 1. A pair of input/output electrodes 5 are formed in predetermined portions of the outer conductor 4. Each of the resonator holes 2*a* and 2*b* has an inner conductor non-formation section 3*a* formed in the vicinity of one opening end surface of the resonator hole to separate (maintain an open circuit) between the inner conductor 3 and the outer conductor 4. At the other opening end of the resonator hole (at the rear side as viewed in FIG. 8), the inner conductor 3 is electrically connected (shorted) to the outer conductor 4. The input/output electrodes 5 are externally coupled with the corresponding inner conductors 3 by external coupling capacitances created between the input/output electrodes 5 and the inner conductors 3.

This dielectric filter is formed of two stages of resonators formed respectively by the resonator holes 2*a* and 2*b*. The resonators are coupled in a comb-line manner by the stray capacitances created at the open ends by the non-formation sections 3*a* formed in the vicinity of the open end surfaces. The thus-constructed dielectric filter, having the resonators coupled with each other by non-formation sections 3*a*, requires no coupling means such as a coupling hole formed between resonator holes 2*a* and 2*b* to couple the resonators in TEM mode, and therefore has the advantage of being capable of being reduced in size.

Ordinarily, this kind of dielectric filter uses a resonant frequency in TEM mode as a fundamental frequency. However, resonance in TE mode, for example, occurs in addition to the resonance in TEN mode. A response at a resonance frequency in this response is an unnecessary mode and is spurious in dielectric filters using TEM mode.

FIG. 9 shows a frequency-attenuation characteristic of a dielectric filter of the above-described construction using a dielectric block having a size of 5 mm along the direction of arrangement of the inner conductors, 4 mm along the lengthwise direction of the inner conductors and 2 mm along the direction of thickness perpendicular to the former two directions, and having a dielectric constant of 92.

As shown in FIG. 9, above a TEM mode fundamental frequency of 1.9 GHz, TE101 mode exists at 5 GHz, TE102 mode at 7.4 GHz, TE201 mode at 8.4 GHz, and TE103 mode at 10.2 GHz. The amount of attenuation at the fundamental frequency of TEM mode is 1 dB while the amount of attenuation of each TE mode is 20 dB. The frequency positions and the amounts of attenuation of these TE modes may be such that the amount of attenuation at double or triple the frequency of TEM mode which is a fundamental mode is smaller, for example 30 bB smaller. In such a case, there is a possibility of failure to achieve a required characteristic (specified value). There is a need to improve the corresponding spurious response characteristic.

In the above-described conventional dielectric filter, however, resonance frequencies (spurious frequencies) of TE mode or the like are determined substantially definitely according to the shape of the dielectric block. Therefore, it has been attempted to change the external size of the dielectric block in order to obtain a required spurious response characteristic. That is, in order to improve the spurious response level (amount of attenuation) at a predetermined (necessary) frequency with respect to each of the different required characteristics to control a spurious frequency of TE mode or the like, the width, thickness and length of the dielectric block are changed according to the required characteristic so that the spurious response is shifted to a higher or lower frequency. In manufacturing the conventional dielectric filter, therefore, there is a need for preparing a multiplicity of dielectric blocks having various shapes for the purpose of improving spurious response characteristics of TE mode or the like according to required characteristics. For this reason, it is difficult to adapt a common or standard dielectric block to the conventional dielectric filter. Therefore, the productivity of the dielectric filter is reduced, the manufacturing cost of the dielectric filter is increased and it is difficult to standardize mounts for the filter.

SUMMARY OF THE INVENTION

In view of the above-described problems of the conventional dielectric filter, an object of the present invention is to provide a dielectric filter capable of easily improving spurious response characteristics of modes other than the fundamental mode (TEM mode) without changing the external shape (size) of the dielectric block.

To achieve the above-described object, according to one aspect of the present invention, there is provided a dielectric filter using TEM mode comprising a dielectric block having a pair of end surfaces, a plurality of inner conductors formed between the pair of end surfaces of the dielectric block, an outer conductor formed on outer surfaces of the dielectric block, non-formation sections formed with the plurality of inner conductors to terminate the inner conductors, and at least one shorting conductor formed in a portion of the dielectric block which is located between the inner conductors and at which the strength of an electric field in a mode other than TEM mode is high, the shorting conductor shorting portions of the outer conductor formed on two major surfaces of the dielectric block said two major surfaces extending parallel to the direction of arrangement of the plurality of inner conductors and also parallel to the lengthwise direction of the plurality of inner conductors.

According to another aspect of the present invention, in the above-described dielectric filter, the inner conductors are formed on inner cylindrical surfaces of resonator holes formed between the pair of end surfaces of the dielectric block.

According to still another aspect of the present invention, in the above-described dielectric filter, the shorting conductor is formed at positions on the two major surfaces of the dielectric block corresponding to ½ of the size of the dielectric block along the direction of arrangement of the inner conductors and also corresponding to ½ of the size of the dielectric block along the lengthwise direction of the inner conductors to suppress spurious response in TE101 mode.

According to a further aspect of the present invention, in the above-described dielectric filter, the shorting conductor is formed at positions on the two major surfaces of the dielectric block corresponding to ¼ of the size of the dielectric block along the direction of arrangement of the inner conductors and also corresponding to ½ of the size of the dielectric block along the lengthwise direction of the inner conductors to suppress spurious response in TE102 mode.

According to still a further aspect of the present invention, in the above-described dielectric filter, the shorting conductor is formed at positions on the two major surfaces of the dielectric block corresponding to ½ of the size of the dielectric block along the direction of arrangement of the inner conductors and also corresponding to ¼ of the size of the dielectric block along the lengthwise direction of the inner conductors to suppress spurious response in TE201 mode.

In the above-described arrangement, the two major surfaces can be maintained at substantially equal potentials at the position at which the shorting conductor is formed, so that the electric field strength at the position at which the shorting conductor is formed can be substantially zero. It is therefore possible to suppress unnecessary spurious response in a mode other than TEM mode by selecting the shorting conductor formation position and the number of shorting conductors.

That is, the shorting conductor is formed in a portion of the dielectric block at which the strength of an electric field in a mode (e.g., TE mode) other than TEM mode is high, thereby limiting resonance in this mode to reduce the response which is considerably high at the frequency at this mode (required frequency). Therefore, dielectric filters having various characteristics and having improved spurious response characteristics can be formed by using dielectric blocks equal in external shape and size.

Other features and advantages of the present invention will become apparent from the following description of embodiments of the invention which refers to the accompanying drawings.

DESCRIPTION OF THE PREFERRED EMBODIMENTS

Figure 1:
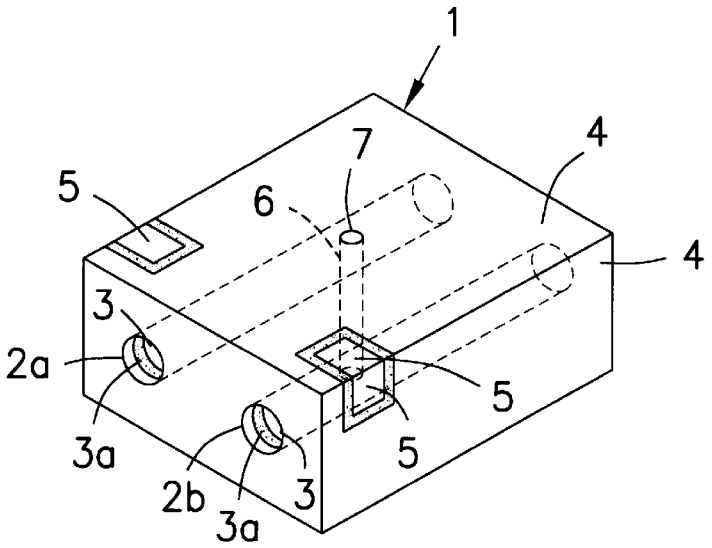
FIG. 1 is a perspective view of an external appearance of a dielectric filter which represents a first embodiment of the present invention.
Figure 5:
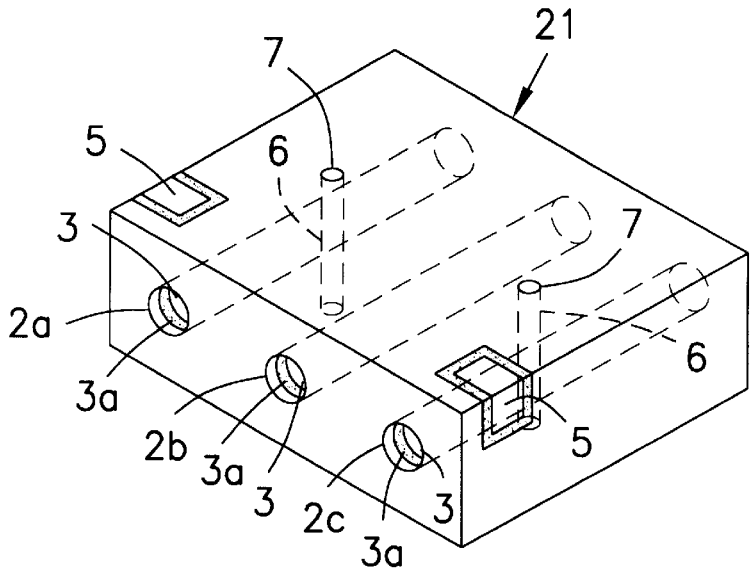
FIG. 5 is a perspective view of an external appearance of a dielectric filter which represents a third embodiment of the present invention.

A dielectric filter which represents a first embodiment of the present invention will be described with reference to FIGS. 1 and 2. In FIGS. 1, 3, and 5, portions identical or corresponding to or having the same functions as those of the conventional dielectric filter are indicated by the same reference characters.

The dielectric filter of the present invention is a filter of a two-stage construction in which two resonator holes 2*a* and 2*b* are formed through one dielectric block 1 between opposite end surfaces of the block. The dielectric block 1 in the form of a rectangular prism has a through hole 6 formed between central portions of its two major surfaces (on the upper and lower sides as viewed in FIG. 1). A shorting conductor 7 for shorting portions of an outer conductor 4 on the two major surfaces of the dielectric block 1 is formed on the inner cylindrical surface of the through hole 6. That is, the through hole 6 having shorting conductor 7 formed on its inner cylindrical surface is formed at the middle of the dielectric block 1 between the opposite end surfaces of the block (as seen along the lengthwise direction of inner conductors) and at the middle of the dielectric block 1 between two side surfaces of the block (as seen along the direction of arrangement of the inner conductors), i.e., between the resonator holes 2*a* and 2*b*.

Figure 8:
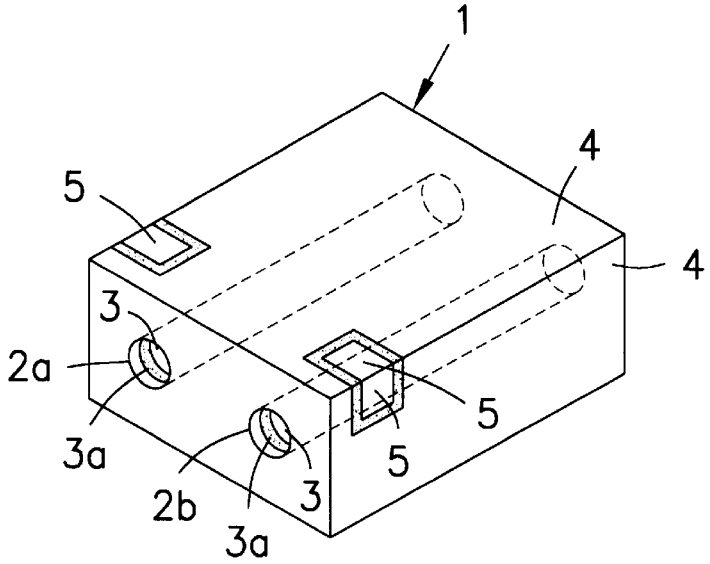
Fig. 8 PRIOR ART
FIG. 8 is a perspective view of an external appearance of a conventional dielectric filter.

The construction of this dielectric filter is the same as that of the conventional dielectric filter shown in FIG. 8 except for the through hole 6 and the connecting conductor 7 formed in the through hole 6. Therefore, the description will not be repeated with respect to the other portions.

In the thus-constructed dielectric filter, portions of the outer conductor 4 on the two major surfaces of the dielectric block 1 are shorted by the shorting conductor 7 in the centers of the two major surfaces, thereby suppressing resonance in TE101 mode so that the spurious response level at the resonance frequency of TE101 mode is advantageously low.

Figure 2:
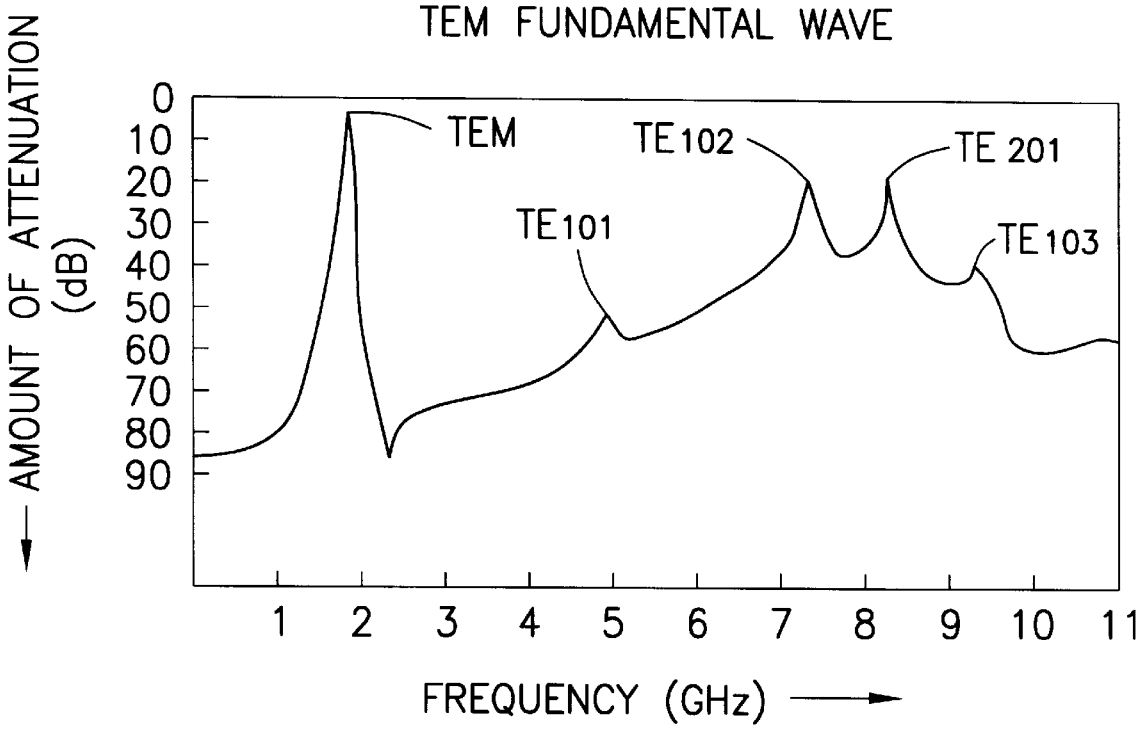
FIG. 2 is a diagram showing a frequency-attenuation characteristic of the dielectric filter shown in FIG. 1.
Figure 3:
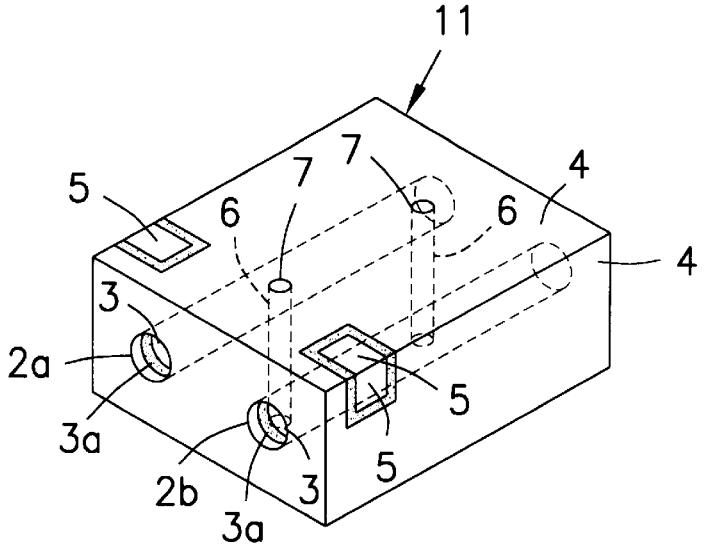
FIG. 3 is a perspective view of an external appearance of a dielectric filter which represents a second embodiment of the present invention.

FIG. 2 shows a frequency-attenuation characteristic of a dielectric filter which is an example of the dielectric filter constructed as shown in FIG. 1. The dielectric block of this dielectric filter has the same size and the same dielectric constant as the dielectric block of the conventional dielectric filter described above, i.e., a size of 5 mm along the direction of arrangement of the inner conductors, 4 mm along the lengthwise direction of the inner conductors and 2 mm along the direction of thickness perpendicular to the former two directions, and a dielectric constant of 92.

As shown in FIG. 2, the amount of attenuation in TE101 mode is 50 dB, which is 30 dB larger than the i corresponding amount of attenuation in the conventional dielectric filter, and a remarkable improvement can be recognized in the attenuation characteristic in the range of 3 to 6 GHz. Also, the amount of attenuation in TE103 mode is 40 dB, which is 20 dB larger. In TE10n mode (n: integer), strong nodal portions of n electric fields occur in the direction of arrangement of the inner conductors and at the middle of the dielectric block as seen along the lengthwise direction of the inner conductors, and strong portions of the electric fields in the mode correspond to the centers of n sections of the dielectric block divided in the direction of arrangement of the inner conductors. Accordingly, if n is an odd number, the center of the dielectric block in the direction of arrangement of the inner conductors necessarily coincides with the strong portion of the electric fields. Therefore, if the potential of this portion is set to 0, the attenuation characteristic at the resonance frequency of a mode of an odd n can be improved. Also, there is a difference of 10 dB between the amount of attenuation in TE101 mode by the shorting conductor and the amount of attenuation in TE103 mode. This is because there are two other strong electric field portions in TE103 mode. If shorting conductors are formed at the other two strong electric field portions, the amount of attenuation of 50 dB, equal to that in TE101 mode, can be obtained.

In the construction of this embodiment, central portions at which the electric field strength is originally maximized in each of two directions parallel to the lengthwise direction of the inner conductors and the direction of arrangement of the conductors (in the state where no shorting conductor is formed) are shorted to limit excitation of TE101 mode. Thus, the spurious level of TE101 mode and TE10n mode when n is an odd number can be remarkably reduced.

FIG. 3 is a perspective view of an external appearance of a dielectric filter which represents a second embodiment of the present invention. The dielectric filter of this embodiment is arranged to suppress spurious response in TE201 mode. Through holes 6 in which shorting conductors 7 are formed for shorting portions of the outer conductor 4 on two major surfaces of a dielectric block 11 are provided at the middle of the dielectric block 11 in the direction of arrangement of inner conductors 3, i.e., between resonator holes 2*a* and 2*b*, and at a distance of ¼ of the size of the dielectric block 11 along the lengthwise direction of inner conductors 3 from the corresponding end surfaces of the block.

TE201 mode has electric field strength maximum points at a distance of ¼ (λ/4) from the opposite end surfaces of the dielectric block 11. That is, in TEn01 mode (n: integer), strong nodal portions of n electric fields occur along the lengthwise direction of the inner conductors and at the middle of the dielectric block in the direction of arrangement of the inner conductors, and strong portions of the electric fields in the mode correspond to the centers of n sections of the dielectric block divided in the direction parallel to the lengthwise direction of the inner conductors. In the dielectric filter of this embodiment, since the outer conductor portions on the two major surfaces are shorted at the positions corresponding to the electric field strength maximum points of TE201 mode, the electric fields of TE201 mode are suppressed and the spurious level of TE201 mode is remarkably reduced.

Figure 4:
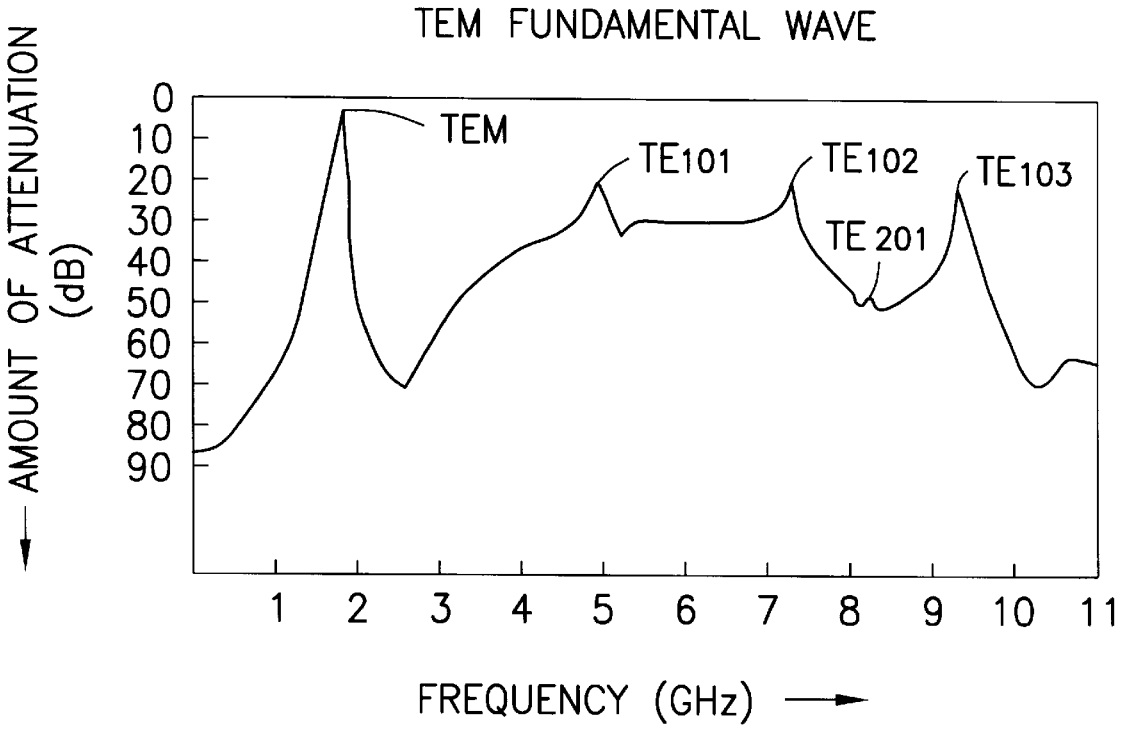
FIG. 4 is a diagram showing a frequency-attenuation characteristic of the dielectric filter shown in FIG. 3.

FIG. 4 shows a frequency-attenuation characteristic of a dielectric filter which is an example of the dielectric filter constructed as shown in FIG. 3. The dielectric block of this dielectric filter has the same size and the same dielectric constant as the dielectric block of the conventional dielectric filter described above, i.e., a size of 5 mm along the direction of arrangement of the inner conductors, 4 mm along the lengthwise direction of the inner conductors and 2 mm along the direction of thickness perpendicular to the former two directions, and a dielectric constant of 92.

As shown in FIG. 4, the amount of attenuation in TE201 mode is 50 dB, which is 30 dB larger than the corresponding amount of attenuation in the conventional dielectric filter, and an improvement can be recognized in the attenuation characteristic about the resonance frequency.

FIG. 5 is a perspective view of an external appearance of a dielectric filter which represents a third embodiment of the present invention. The dielectric filter of this embodiment is arranged to suppress spurious response in TE102 mode. The dielectric filter of this embodiment is constructed by using three resonators 2*a*, 2*b*, and 2*c*. Portions of this embodiment identical or corresponding to those shown in FIG. 1 are indicated by the same reference characters, and the description for them will not be repeated. Through holes 6 in which shorting conductors 7 are formed for shorting portions of the outer conductor 4 on two major surfaces of a dielectric block 21 are provided at the middle of the dielectric block 21 as seen along the lengthwise direction of inner conductors 3, i.e., at equal distances from opposite end surfaces of the dielectric block 21 in which the resonator holes 2*a*, 2*b*, and 2*c* have their openings, and at a distance of ¼ of the size of the dielectric block 11 in the direction of arrangement of inner conductors 3 from side surfaces of the block facing in this direction.

TE102 mode has electric field strength maximum points at equal distances from the opposite end surfaces of the dielectric block 21 and at a distance of ¼ (λ/4) from the side surfaces of the block. In the dielectric filter of this embodiment, the outer conductor portions on the two major surfaces are shorted at the positions at which the electric field strength of TE102 mode is maximized, so that the electric fields of TE102 mode are suppressed and the spurious level of TE102 mode is remarkably reduced.

Figure 7:
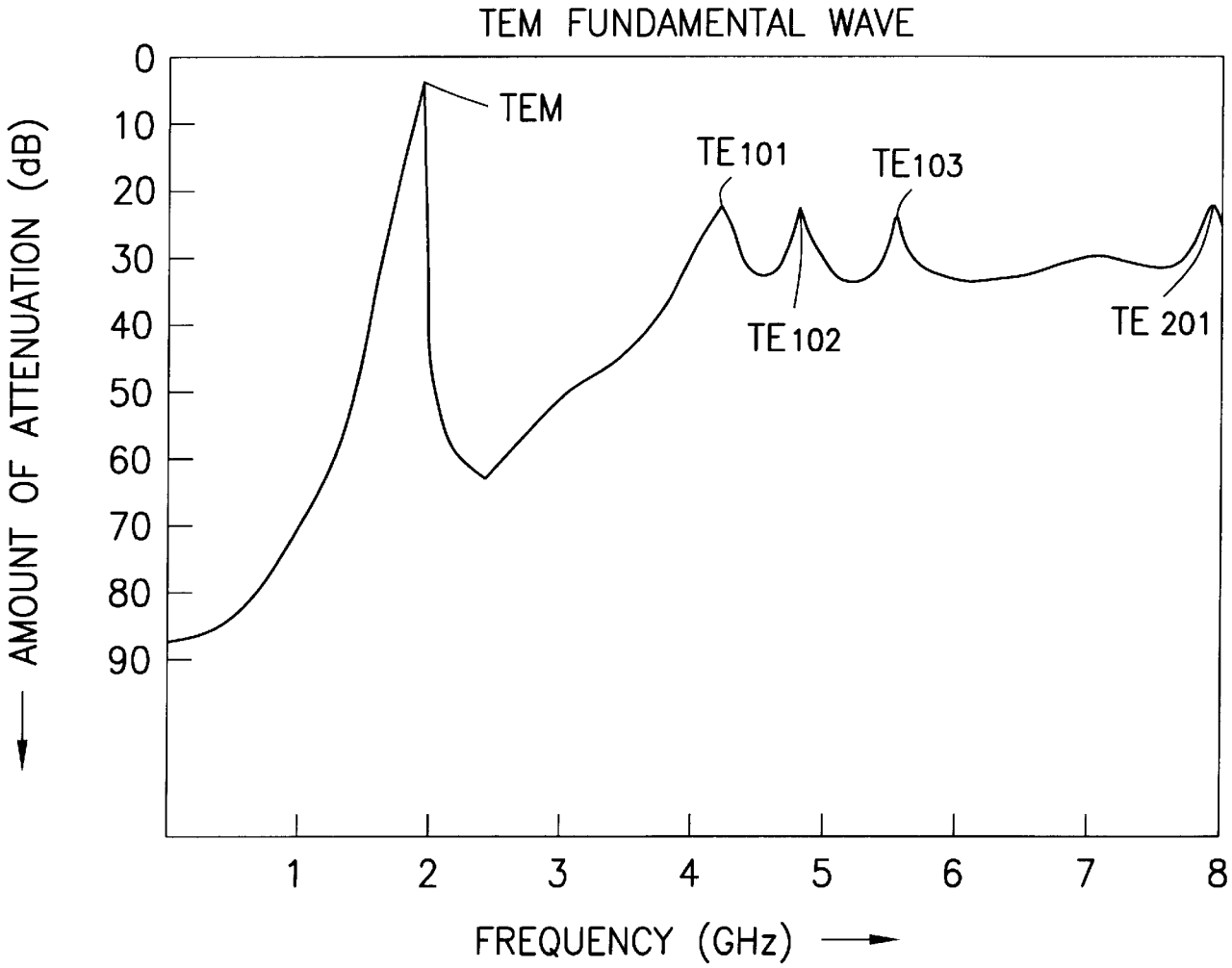
FIG. 7 is a diagram showing a frequency-attenuation characteristic of a dielectric filter of the conventional construction made for comparison with the third embodiment of the present invention.

FIG. 7 shows a frequency-attenuation characteristic of a dielectric filter of the conventional construction made for comparison with this embodiment. This dielectric filter has three resonator holes such as those shown in FIG. 5 but has no through hole 6 and no shorting conductor 7. The dielectric block of this dielectric filter has a size of 12 mm along the direction of arrangement of the inner conductors, 4 mm along the lengthwise direction of the inner conductors and 2 mm along the direction of thickness perpendicular to the former two directions, and has a dielectric constant of 92.

Figure 9:
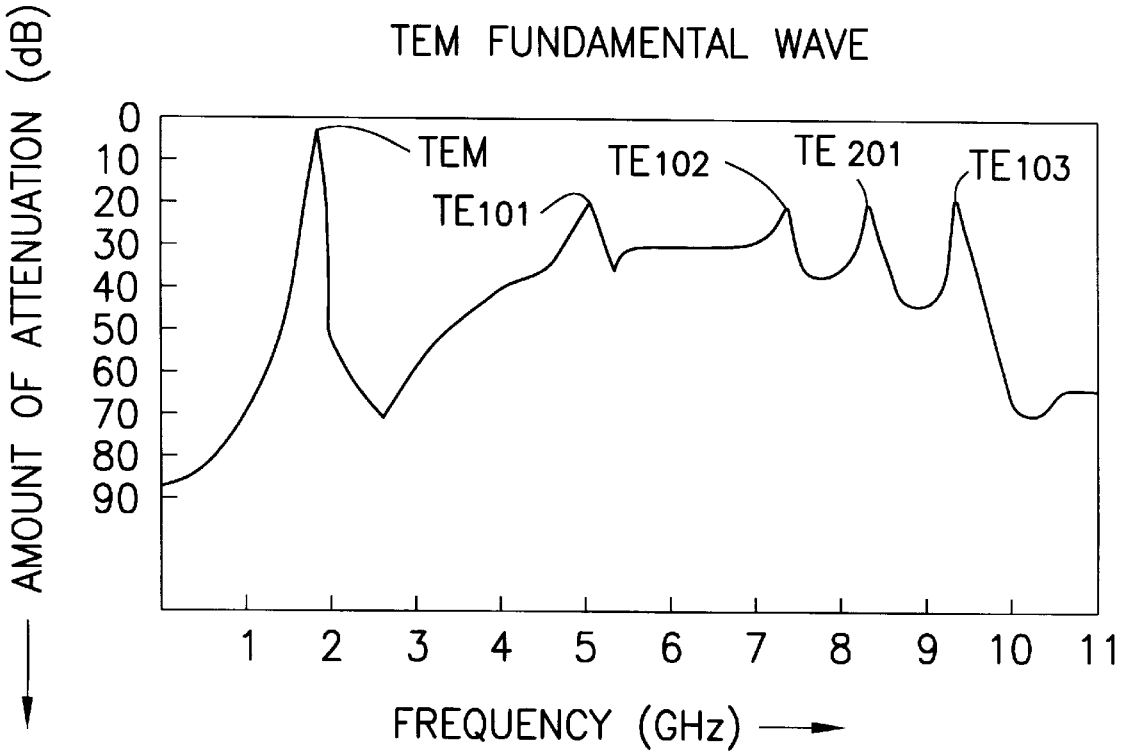
Fig. 9 PRIOR ART
FIG. 9 is a diagram showing a frequency-attenuation characteristic of the conventional dielectric filter.

As shown in FIG. 7, above a TEM mode fundamental frequency of 1.9 GHz, TE101 mode exists at 4.1 GHz, TE102 mode at 4.7 GHz, TE103 mode at 5.5 GHz, and TE201 mode at 7.9 GHz. The fundamental frequency of TEM mode in this example is the same as the fundamental frequency of 1.9 MHz in the characteristic shown in FIG. 2 because the length of the inner conductors is unchanged. On the other hand, all the resonance frequencies of the TE modes are reduced because the size of the entire dielectric block is changed. Further, TE201 mode exists at a frequency higher than that of TE103 mode, which relationship is the reverse of that shown in FIG. 2 with respect to the arrangement using two resonators. This is because the size of the dielectric block along the direction of arrangement of the inner conductors is changed while the size along the lengthwise direction of the inner conductors is unchanged. The amount of attenuation is 1 dB at the fundamental frequency of TEM mode and 20 dB at the resonance frequency of each TE mode, as is the attenuation in the characteristic shown in FIG. 9.

Figure 6:
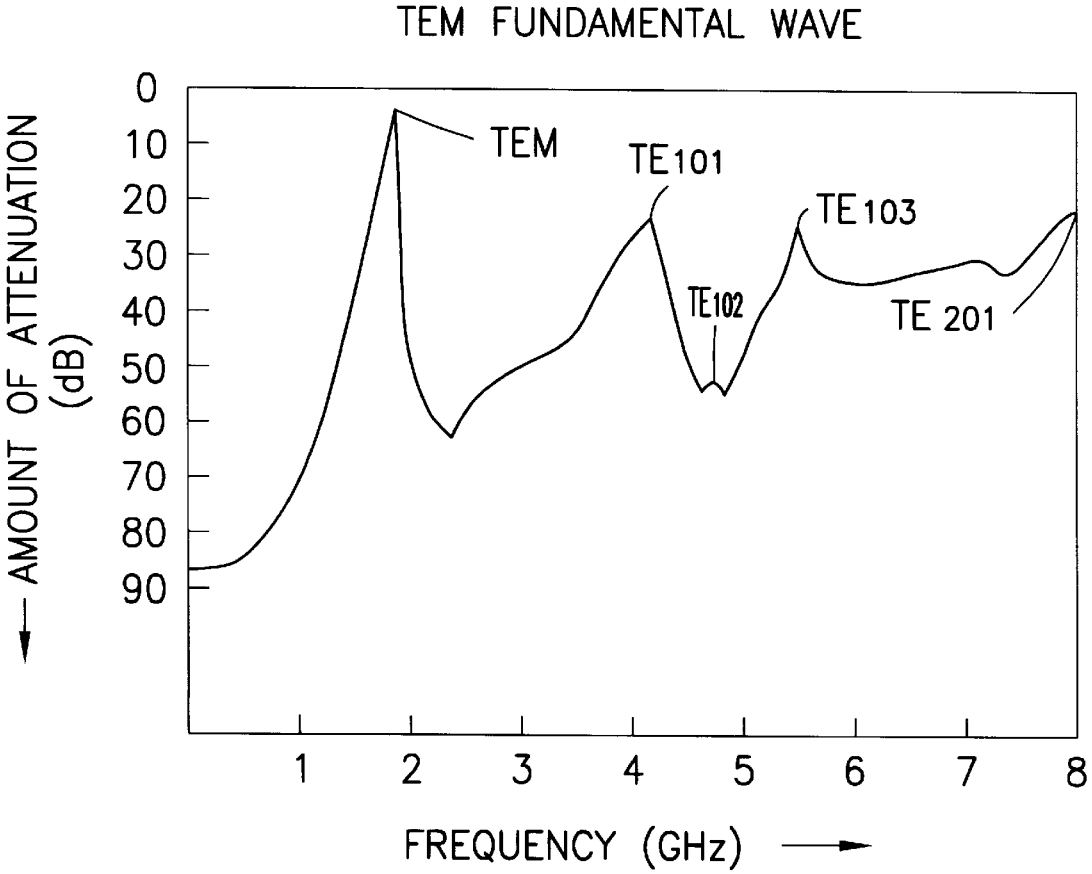
FIG. 6 is a frequency-attenuation characteristic of the dielectric filter shown in FIG. 5.

FIG. 6 shows a frequency-attenuation characteristic of an example of the dielectric filter constructed as shown in FIG. 5. The parameters of the dielectric block are set to the same values as those in the dielectric block a characteristic of which is shown in FIG. 7.

As shown in FIG. 6, the amount of attenuation in TE102 mode is 50 dB, which is 30 dB larger than the corresponding amount of attenuation in the conventional dielectric filter, and an improvement can be recognized in the attenuation characteristic about the resonance frequency.

As described above, the present invention is arranged to improve a spurious response characteristic which does not satisfy a requirement with respect to a mode other than TEM mode used as a fundamental mode. The construction of the first embodiment is applied to a case where the spurious level of TE101 mode is a problem, the construction of the second embodiment is applied to a case where spurious response in TE101 mode is a problem, and the construction of the third embodiment is applied to a case where spurious response in TE101 mode is a problem.

Thus, the present invention is provided for the purpose of improving the effect of limiting undesirable spurious response in a mode such as TE mode, and each shorting conductor is provided at such a position as to effectively reduce the spurious level at a particular frequency of a mode other than TEM mode while minimizing suppression of TEM mode. The influence of the shorting conductor upon the frequency-attenuation characteristic of TEM mode is smaller if the diameter of the through hole in which the shorting conductor is formed is smaller or if the position of the shorting conductor is remoter from the inner conductor non-formation section provided to form the open end. For example, a thin wire may be used as the shorting conductor instead of the conductor formed on the inner cylindrical surface of a through hole. The thin wire is embedded in the dielectric block to short portions of the conductor formed on the two major surfaces of the dielectric block, thereby setting the potential at the shorting position to zero. A suitable attenuation characteristic can also be achieved in this manner.

Needless to say, the present invention is not limited to the above-described embodiments and can also be applied to a dielectric filter having three or more stages of resonators, to a Tri-plate type filter using TEM mode and having microstrip lines formed as inner conductors, and to a duplexer or multiplexer in which these types of filters are integrally formed.

The arrangement may alternatively be such that connecting terminals such as resin pins, for example, are provided instead of the above-described input/output electrodes and are inserted into the input/output stage resonators to connect the filter to an external circuit.

In the dielectric filter of the present invention, as described above, a shorting conductor for shorting the portions of the outer conductor on the two major surfaces of the dielectric block is formed in the dielectric block at a predetermined position, thereby reducing the level of spurious response in a mode other than TEM mode to a level not higher than a specified level. Therefore, a spurious response characteristic can be improved without changing the external shape and size of the dielectric block, so that the dielectric block can be designed as a common or standard component. Thus, it is possible to achieve an improvement in producibility, a reduction in manufacturing cost, standardization of mount bases and a reduction in mounting cost.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter for using the TEM mode comprising:

a dielectric block having a pair of end surfaces;

a plurality of resonators comprising respective inner conductors extending between the pair of end surfaces of said dielectric block;

an outer conductor formed on outer surfaces of said dielectric block;

non-conductive sections adjacent to respective ones of said plurality of inner conductors and defining respective ends of said ones of said plurality of inner conductors; and a shorting conductor disposed in a portion of said dielectric block which is located between a corresponding pair of said resonators and at which the strength of an electric field in a mode other than the TEM mode is high when said corresponding pair of resonators are excited, wherein said shorting conductor shorts portions of said outer conductor formed on two major surfaces of said dielectric block, said two major surfaces extending parallel to the direction of arrangement of said plurality of inner conductors and also parallel to the lengthwise direction of said plurality of inner conductors, and wherein said shorting conductor is provided by an inner conductor in a throughhole extending between said two major surfaces;

wherein said shorting conductor is disposed only at a position located at ½ of a dimension of said dielectric block along the direction of arrangement of said inner conductors, and at ½ of another dimension of said dielectric block along the lengthwise direction of said inner conductors, so as to suppress spurious response in the TE101 mode.

2. A dielectric filter for using the TEM mode comprising:

a dielectric block having a pair of end surfaces;

a plurality of resonators comprising respective inner conductors extending between the pair of end surfaces of said dielectric block;

an outer conductor formed on outer surfaces of said dielectric block;

non-conductive sections adjacent to respective ones of said plurality of inner conductors and defining respective ends of said ones of said plurality of inner conductors; and a shorting conductor disposed in a portion of said dielectric block which is located between a corresponding pair of said resonators and at which the strength of an electric field in a mode other than the TEM mode is high when said corresponding pair of resonators are excited, wherein said shorting conductor shorts portions of said outer conductor formed on two major surfaces of said dielectric block, said two major surfaces extending parallel to the direction of arrangement of said plurality of inner conductors and also parallel to the lengthwise direction of said plurality of inner conductors, and wherein said shorting conductor is provided by an inner conductor in a throughhole extending between said two major surfaces;

wherein said shorting conductor is disposed only at a position located at ¼ of a dimension of said dielectric block along the direction of arrangement of said inner conductors, and at ½ of another dimension of said dielectric block along the lengthwise direction of said inner conductors, so as to suppress spurious response in the TE102 mode.

3. A dielectric filter according to claim 1, wherein said inner conductors and non-conductive sections are disposed on inner cylindrical surfaces of resonator holes which extend between the pair of end surfaces of said dielectric block.

4. A dielectric filter according to claim 3, further comprising a pair of input/output electrodes disposed on said dielectric block so as to be capacitively coupled with corresponding ones of said plurality of resonators, said outer conductor being formed on the entire outer surface of said dielectric block except for portions surrounding said input/output electrodes.

5. A dielectric filter according to claim 1, further comprising a pair of input/output electrodes disposed on said dielectric block so as to be capacitively coupled with corresponding ones of said plurality of resonators, said outer conductor being formed on the entire outer surface of said dielectric block except for portions surrounding said input/output electrodes.

6. A dielectric filter according to claim 2, further comprising a pair of input/output electrodes disposed on said dielectric block so as to be capacitively coupled with corresponding ones of said plurality of resonators, said outer conductor being formed on the entire outer surface of said dielectric block except for portions surrounding said input/output electrodes.

7. A dielectric filter for using the TEM mode comprising:

a dielectric block having a pair of end surfaces, and side surfaces extending between said end surfaces;

three resonators comprising respective inner conductors extending between the pair of end surfaces of said dielectric block, and disposed so as to define a direction of arrangement between two opposed side surfaces of said dielectric block;

an outer conductor formed on outer surfaces of said dielectric block;

non-conductive sections adjacent to respective ones of said plurality of inner conductors and defining respective ends of said ones of said plurality of inner conductors; and a pair of shorting conductors, each disposed respectively in a portion of said dielectric block which is located between a corresponding pair of said resonators and at which the strength of an electric field in a mode other than the TEM mode is high when said corresponding pair of resonators are excited, wherein said shorting conductors short portions of said outer conductor formed on two major surfaces of said dielectric block, said two major surfaces extending parallel to the direction of arrangement of said plurality of inner conductors and also parallel to the lengthwise direction of said plurality of inner conductors, wherein said shorting conductors are provided by respective inner conductors in corresponding throughholes extending between said two major surfaces, and wherein each said shorting conductor is disposed only at a position located at ¼ of a dimension of said dielectric block along the direction of arrangement of said inner conductors, from a corresponding one of said two opposed side surfaces, and at ½ of another dimension of said dielectric block along the lengthwise direction of said inner conductors, so as to suppress spurious response in the TE102 mode.

8. A dielectric filter according to claim 7, wherein said inner conductors and non-conductive sections are disposed on inner cylindrical surfaces of resonator holes which extend between the pair of end surfaces of said dielectric block.

9. A dielectric filter according to claim 8, further comprising a pair of input/output electrodes disposed on said dielectric block so as to be capacitively coupled with corresponding ones of said plurality of resonators, said outer conductor being formed on the entire outer surface of said dielectric block except for portions surrounding said input/output electrodes.

10. A dielectric filter according to claim 7, further comprising a pair of input/output electrodes disposed on said dielectric block so as to be capacitively coupled with corresponding ones of said plurality of resonators, said outer conductor being formed on the entire outer surface of said dielectric block except for portions surrounding said input/output electrodes.

* * * * *